US010663925B2

(12) United States Patent
Abramov et al.

(10) Patent No.: US 10,663,925 B2
(45) Date of Patent: May 26, 2020

(54) HYBRID SMART WATCH MULTIPLE SOURCES OF TIME, MULTIPLE POWER SOURCES, AND MULTIPLE TIME INDICATOR MECHANISMS

(71) Applicant: Andrey Abramov, Foster City, CA (US)

(72) Inventors: Andrey Abramov, Foster City, CA (US); Eric Burger, Great Falls, VA (US)

(73) Assignee: Andrey Abramov, Foster City, CA (US)

( * ) Notice: Subject to any disclaimer, the term of this patent is extended or adjusted under 35 U.S.C. 154(b) by 213 days.

(21) Appl. No.: 15/555,003

(22) PCT Filed: Apr. 27, 2016

(86) PCT No.: PCT/US2016/029409

§ 371 (c)(1),
(2) Date: Aug. 31, 2017

(87) PCT Pub. No.: WO2016/141393

PCT Pub. Date: Sep. 9, 2016

(65) Prior Publication Data

US 2018/0039232 A1 Feb. 8, 2018

Related U.S. Application Data

(60) Provisional application No. 62/126,614, filed on Mar. 1, 2015.

(51) Int. Cl.
*G04G 21/00* (2010.01)
*G04B 47/00* (2006.01)
(Continued)

(52) U.S. Cl.
CPC ..... *G04B 47/00* (2013.01); *G04C 17/0091* (2013.01); *G04G 9/0082* (2013.01);
(Continued)

(58) Field of Classification Search
CPC ..... G04B 47/00; G04G 19/12; G04C 17/00; G04C 17/0091
See application file for complete search history.

(56) References Cited

U.S. PATENT DOCUMENTS 4,413,915 A * 11/1983 Besson ..... G04G 9/0082 349/113
7,420,885 B2 * 9/2008 Claret ..... G04B 19/065 368/223
(Continued)

FOREIGN PATENT DOCUMENTS

EP 2851756 A2 3/2015
EP 2913723 A1 9/2015

OTHER PUBLICATIONS

EP16759660, Supplementary Partial European Search Report, dated Oct. 18, 2018, 13 pages.

*Primary Examiner* — Sean Kayes
(74) *Attorney, Agent, or Firm* — Han Santos, PLLC

(57) ABSTRACT

A hybrid wearable device comprising (A) a smart watch with at least a digital display, a general-purpose processor, an instruction and data memory, and a communications component, and (B) an alternate (mechanical, quartz, kinetic, or other) watch movement, that has these two components interact with each other and with the user.

17 Claims, 11 Drawing Sheets

(51) Int. Cl.

| | |
|---|---|
| ***G04G 19/12*** | (2006.01) |
| ***G04G 9/00*** | (2006.01) |
| ***G04C 17/00*** | (2006.01) |
| *G04G 21/08* | (2010.01) |
| *G04B 19/04* | (2006.01) |

(52) U.S. Cl.
CPC ..... *G04G 19/12* (2013.01); *G04B 19/042* (2013.01); *G04G 21/08* (2013.01)

(56) References Cited

U.S. PATENT DOCUMENTS

| | | | | |
|---|---|---|---|---|
| 9,152,129 | B2 * | 10/2015 | Modaragamage | A44C 5/24 |
| 9,551,975 | B2 * | 1/2017 | Weiser | G03H 1/0011 |
| 2002/0048221 | A1 * | 4/2002 | Basturk | G02F 1/133533 368/84 |
| 2005/0243653 | A1 * | 11/2005 | Lizzi | G04G 9/0082 368/71 |
| 2008/0130423 | A1 * | 6/2008 | Claret | G04B 19/065 368/309 |
| 2015/0301506 | A1 | 10/2015 | Koumaiha | |
| 2016/0109861 | A1 * | 4/2016 | Kim | G04G 21/08 368/69 |

* cited by examiner

HYBRID SMART WATCH MULTIPLE SOURCES OF TIME, MULTIPLE POWER SOURCES, AND MULTIPLE TIME INDICATOR MECHANISMS

TECHNICAL FIELD

The present invention generally relates to the field of wearable devices, more particularly to the apparatus commonly referred to as "smart watches", as well as to other wearable timepieces, as well as the methods of combining such devices together.

BACKGROUND

Smart watches, also often referred to as "smartwatches", are portable electronic devices, worn like a wristwatch, or like a fashion accessory on a strap, or a belt, or some other fashion or jewelry contrivance. Smart watches are essentially small computers, as they include a processor, some memory, a display, a communication component, an ability to accept user input, and an ability to download and execute a variety of application software.

Like all electronic devices, smart watches depend for their functioning on having a built-in source of time, which enables them to perform the key function of a conventional timepiece: display the current time.

The ability of a smart watch to display the time is commonly seen as a cornerstone function of the device. A smart watch that does not function as a watch is usually seen as showing an unacceptable regression of its most basic function. Such device cannot be classified as a smart watch and would have to compete for space on the wrist of the user against a conventional watch that actually shows time and belongs on the wrist by custom and tradition.

In many human cultures, particularly the ones relying on the daily use of electronic devices, personal time management and thus immediate access to the current time are accepted as a common and essential utility. Various wristwatches with mechanical, quartz, kinetic, and other movements are commonly available and have established clear expectations of dependability.

Thus a need exists for an apparatus combining the benefits of the extensive functionality of smart watches with an ability to display time, similar in its dependability to traditional mechanical, quartz, and kinetic timepieces.

SUMMARY OF THE INVENTION

Aspects of the present invention address at least the above-mentioned problems and/or disadvantages and provide at least the advantages described below. Accordingly, an aspect of the present invention introduces an apparatus combining a smart watch and a conventional watch movement together into a "hybrid smart watch", to offer the benefits of both.

The invention therefore concerns a hybrid wearable device comprising (A) a smart watch with at least a pixel-addressable digital display, a general purpose processor, an instruction and data memory, and a communications component, said "smart watch" component also referred to as "digital subsystem" or "electronic component" from here on, and (B) an alternate (mechanical, quartz, kinetic, or other) watch movement (or, possibly, multiple movements), also referred to from here on as "analog subsystem" or "conventional movement."

A smart watch and an alternate, conventional (mechanical, quartz, kinetic, or other) movement each can have a dedicated power source, such a battery, capacitor, mainspring, mechanical rotor or some other means of storing and releasing energy, from here on is referred to as "energy storage". The process of adding energy to the energy storage, whether electrical or mechanical, from here on is referred to simply as "charging".

An analog time indicator in the form of a mechanical dial, where passage of time or change in other data, like, for example, power reserve, is indicated by physically moving one element relative to another, or any of the many embodiments known in the timepiece industry (from here on simply referred to as "analog dial" for brevity) is shown to the user. A smart watch pixel-addressable digital display is also shown to the user.

The analog dial indicates the time as established by the conventional movement within the hybrid smart watch. The digital display may indicate the time as established by the electronic component of the hybrid smart watch, or it may display the information imparted by various applications that may or may not relate to the time measurement function of the hybrid smart watch.

The analog dial and the digital display may be combined to offer enhanced functionality, and multiple analogue dials and digital displays may be combined within a single hybrid smart watch.

The electronic component of the hybrid smart watch can be further combined with the conventional movement or movements to facilitate time display such that at times the analog dial displays the time as measured by the electronic components, and/or the digital display shows time as measured by the conventional movement.

Elements of the analog dial may be integrated with the electronic component of a hybrid smart watch in such a fashion that the elements of an analog dial may be utilized to indicate information outside of time measurement domain, such as, for example, direction, air quality, radiation levels, available storage capacity, strength of communication signal, or any of the myriad other measurements available to the electronic component of the hybrid smart watch.

The electronic component of the hybrid smart watch can be further combined with the conventional movement to provide the benefits of integration, for example, to measure the precision of the conventional movement and sense the time it displays, adjust the conventional movement to display the correct time as indicated by the network services, regulate the subsystems of conventional movement so that they measure time with higher precision, change the time indicated by the conventional movement to adjust to a time zone change, wind up the spring of a mechanical movement (or otherwise charge up the power storage dedicated to a quartz movement) using the electronic component of the hybrid smart watch as the power source.

Electronic elements of the hybrid smart watch may control and/or utilize one or several forms of energy harvesting, including, but not limited to any combination of some or all of photovoltaic, piezoelectric, thermoelectric, kinetic, radio, microwave or some other form of energy harvesting. The harvested energy may then be used to wind up or otherwise recharge, drive, or augment the power source of the conventional (mechanical, quartz, kinetic, or other) movement.

Other aspects, advantages, and salient features of the invention will become apparent to those skilled in the art from the following detailed description, which, taken in conjunction with the annexed drawings, discloses various embodiments of the present invention.

BRIEF DESCRIPTION OF THE DRAWINGS

The above and other aspects, features, and benefits of certain embodiments of the present invention will be more apparent from the following description taken in conjunction with the accompanying drawings in which.

DETAILED DESCRIPTION

Technical Problem

The ability of a computing device to perform its functions, including the function of displaying time, depends on the availability of electrical power. Wearable devices are, by their nature, usually disconnected from the power grid and thus rely on battery power. Yet the power supplied by the batteries is constrained by the wearable form factor itself—there is only so much one is usually willing to carry on the wrist.

One of the biggest consumers of power in a smart watch has been the display, to the point where many smart watches can sustain only a precious few hours of operation with the display constantly switched on. Various methods for constraining the power-consuming uses of smart watches have been implemented, but they all clash with the consumer's desire to enjoy the device in its full functionality.

Thus there is a contradiction: smart watches instigate more active use than conventional timepieces, yet once a smart watch is out of power it cannot even tell the time.

Similarly, while connected smart watches can automatically adjust their time to match precisely the time and time zone provided by specialized network services, thus significantly exceeding the precision of the mechanical movements that require a manual intervention of the user or a skilled professional to avoid time drift, even perfect precision is moot when a smart watch cannot show the time. Yet the mechanical movements do not lend themselves to an automatic adjustment to network time.

Overview

The following detailed description of the invention is intended to assist in a comprehensive understanding of various embodiments of the invention as defined by the claims and their equivalents. Accordingly, those of ordinary skill in the art will recognize that various modifications of the embodiments described herein can be made without departing from the scope and spirit of the current invention. In addition, descriptions of well-known functions and constructions may be omitted for clarity and conciseness.

These detailed description of the invention are to be regarded as merely exemplary in nature and are not intended to limit the invention or the application and uses of the invention. Furthermore, there is no intention to be bound by any theory presented in the preceding background or the following detailed description.

It is to be understood that the singular forms "a," "an," and "the" include plural referents unless the context clearly dictates otherwise. Thus, for example, reference to "a communications unit" includes reference to one or more such units.

The following various embodiments describe a hybrid smart watch with multiple sources of time, multiple power sources, and multiple time indicator mechanisms.

Figure 8:
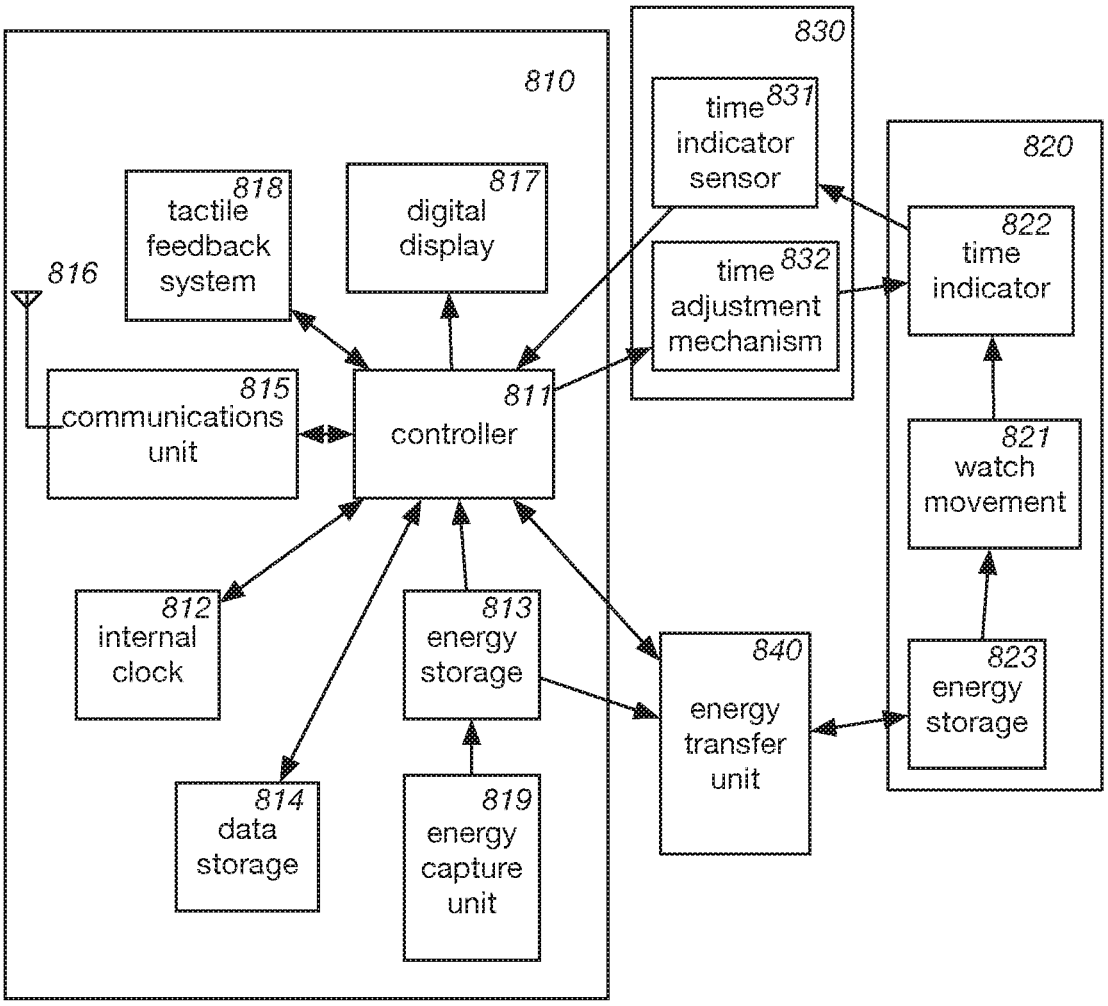
FIG. 8 presents a block diagram of one embodiment of a hybrid smart watch, showing the digital and analogue subsystems and possible interactions among them.

FIG. 8 is a block diagram presenting one embodiment of a hybrid smart watch, containing the digital subsystem 810, the analog watch subsystem 820, and the time adjustment subsystem 830 and the energy transfer unit 840.

Referring to FIG. 8, the digital subsystem may include a controller 811, a communication unit 815 with an external interface 816, a digital display 817, a tactile feedback system 818, an internal clock 812, data storage 814, and energy storage 813.

The controller 811 may control general operations of the digital subsystem 810 and a signal flow between the components within. More particularly, it may execute various application and system software residing in the data storage 814 or elsewhere, perform operations on the system and user data residing in the data storage 814 or available over the communication unit 815, display the data and user interface elements via the digital display 817, read and set the internal clock 812, read the state of the energy storage 813, interact and control the time interaction subsystem 830, and engage the energy transfer unit 840.

The data storage 814 may store a program code required for operations according to an embodiment of the present invention, user data, or the like. For example, the storage unit 814 may store a program that controls general operations of the digital subsystem 810, applications required for an operating system (OS) booting the digital subsystem 810, interacting over various communications protocols such as IP, Bluetooth, ZigBee, Wi-Fi, LTE, and the like, and additional functions of the digital subsystem 810 of the hybrid smart watch, including but not limited to all or any of a camera function, a music playback function, an image display function, a video play function, or the like. More particularly, the storage unit 814 may store user preferences regarding the automatic adjustment of the analog subsystem when a time correction is suggested by the digital subsystem, for example when the digital sub-system discovers that the user has entered a different time zone, or when the analog subsystem has been deviating from the expected time by a certain, configurable amount, for example three seconds or more.

The communication unit 815 may form wireless or wired communication channels with other devices and network services. It may have a single communication interface 816 or multiple communication interfaces as needed. In fact, multiple, medium-specific communications units might be employed in various embodiments of the present invention. The communication unit 815 may use a communication technology such as Ethernet, Universal Serial Bus (USB), Bluetooth, infrared communication, Wi-Fi, Wi-Fi Direct, home RF, DLNA, ZigBee, or the like. More particularly, the communication unit 815 may form a communication channel with a network time service employing NTP or a functionally similar protocol, and may thus discover events such as clock drift or time zone change. Such events may trigger the controller 811 to make automatic adjustments, or to communicate the need for such adjustments to the user via the digital display 817, the tactile feedback system 818, or some other means.

Figure 1:
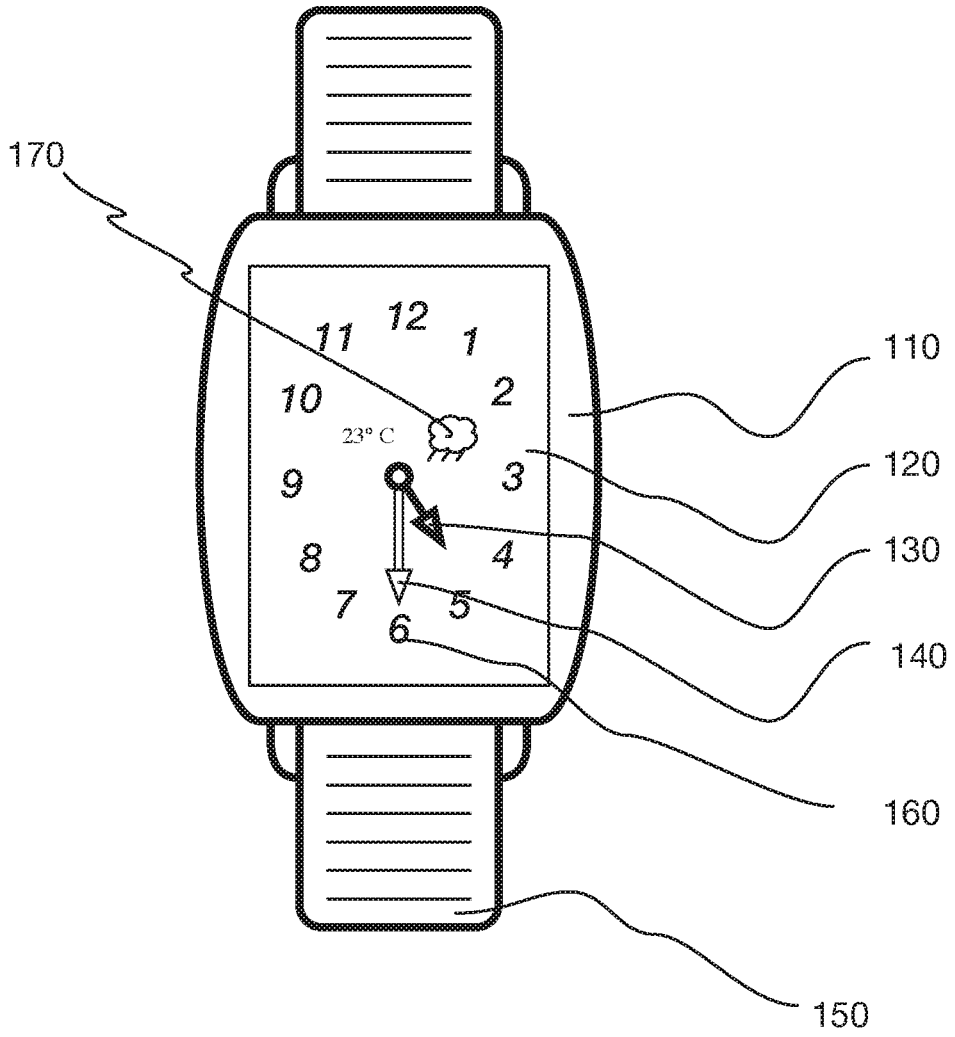
FIG. 1 illustrates a front view of a hybrid smart watch with a rectangular digital display where the hour and minute hands of the analogue watch dial overlay the digital display.

The digital display 817 shows the information and user interface presented by the applications and the operating system executed within the digital subsystem of the hybrid smart watch, information provided by external devices via the communication unit 815, or the information generated by various sensors and components of the digital subsystem, as well as the sensors and components interacting with the analog subsystem of the smart watch. For example, the display unit 817 may provide work areas for various applications such as a weather report, a message reader, a digital timer, a power indicator, a "wondering", "jumping", or retrograde indicator, while also showing a dial that would indicate the time when considered in conjunction with the analog time indicator 822, such as the mechanical hour and minute hands as shown in FIG. 1.

The tactile feedback system 818 drives one or many mechanisms that provide information to the user of the hybrid smart watch via one or more haptic mechanisms. Such mechanisms may be simple like a single-point pressure actuator, or complex, with patterns extended in time and across multiple pressure points. For example, when the controller 811 determines that the time in the internal clock 812 deviates from the time as known to the analog subsystem 820 of the hybrid smart watch by a certain preconfigured amount, it may alert the user by sending a tactile pattern that would be perceived by the user as an alert requiring a human intervention.

The internal clock 812 is an essential component of any electronic system and thus of the digital subsystem 810. The digital subsystem may contain multiple such clocks necessary for the operation of its components. The internal clock does not necessarily have to keep track of the date or the hour, but rather of the passage of time. The controller 811 may translate the passage of time as indicated by the internal clock 812 into the current date and time as perceived by humans. The controller 811 may request and receive the current time and date from various network services via the communications unit 815. Once the controller 811 arrives, as a result of a network dialogue via communications unit 815, at what it perceives to be an accurate current time, it may adjust the internal clock 812, or adjust the formula it uses to translate the time reported by the internal clock 812 into the time in human-readable format. Likewise, the time as reported by the internal clock 812 or arrived at through a network transaction via communications unit 815 may be used to adjust the time in the analog subsystem 820. Thus an external source can be utilized to adjust either the internal time of the hybrid smart watch, or the time displayed by the hybrid smart watch on its digital or analog dial(s).

The energy storage 813 provides electric power to all the components of the digital subsystem 810, as well as time adjustment sub-system 830, and may provide power to the energy transfer unit 840 as well. The energy storage 813 is charged by an energy capture unit 819, which receives energy from a wired source such as USB power, a power harvesting subsystem, a wireless source such as inductive charging, or the like. The controller 811 can receive indications of the amount of power stored within energy storage 813 and adjust the behavior of the digital subsystem 810 and its components accordingly, as well as alert the user. The power contained within the energy storage 813 could be used to charge the energy storage 823 of the analog subsystem of the hybrid smart watch. Mechanisms for efficiently and safely regulating and charging small power sources are well-known in the art and will not be enumerated here.

Although not illustrated in FIG. 8, the digital subsystem 810 may further include optional components for providing additional functions, such as a camera module for photographing an image or a video, a broadcasting reception module for receiving broadcasts, a digital music playback module, and a sensor module for proximity, acceleration, radiation, and other sensing. All the types of components cannot be listed since a variation on the components varies greatly according to a convergence trend of digital devices, and the digital subsystem 810 of a hybrid smart watch according to embodiments of the present invention may further include components in a level equal to that of the above listed components.

Still referring to FIG. 8, the analog subsystem of a hybrid smart watch may include an energy storage 823, such as a spring, battery, capacitor, fuel cell, or the like, a watch movement 821, and a time indicator 822 such as an analog dial with hour, minute and second hands. When considered alone, on its own merits, and without the rest of the hybrid smart watch, the analog subsystem is similar to a common wristwatch.

The time indicator 822 may be any of the known analog time indicators using, for example, separate hands to indicate hours, minutes, seconds, and fractions thereof, or a wondering hour dial, a sun-and-moon dial, a mystery dial, a jumping or retrograde display, or any other mechanical contrivance for showing time. The time indicator 822 may rely on the digital display 817 to provide the context for the time it displays, such as digitally displayed hour and minute marks, or the current hour in case of the wondering hour time indicator. The time indicator 822 may include multiple interrelated or independent indicators, showing different times or the same time in different formats, driven by the same movement or by multiple watch movements. The time indicator may also display the date or dates as per various calendars, as well as the time elapsed from a certain moment, or time remaining until a certain moment in the future.

The time currently shown by the time indicator 822 may be captured by the time indicator sensor 831 and reported to the controller 811. The time indicator itself may be adjusted by the time adjustment mechanism 832 based on a command from the controller 811. For example, in one embodiment of the invention, the controller 811 would discover as a result of a transaction with a network time service like GPS, GSM, or LTE that the hybrid smart watch has entered a different time zone, and would command the time adjustment mechanism 832 to move the hour and minute hands of the time dial to match the local time. In another embodiment, the controller 811 may command the time adjustment mechanism 832 to regulate the conventional mechanism so as to improve precision of the same. In another embodiment, the watch asks the user if they wish to have the time adjusted. For example, some people who travel like to keep the conventional watch indicating their home time.

The watch movement 821, such as mechanical, quartz, kinetic, or some other movement, counts the time and controls the state of the time indicator 822 using power from the energy storage 823. A hybrid smart watch may have more than one watch movement, just as it may have more than one time indicator. The watch movement may track the time based on the common 24-hour day scale and the Gregorian calendar, or may track the sidereal time, the solar time, or other times such as measured by various cultural and religious traditions. The watch movement may also use Gregorian, Mayan, or any of the multitudes of other calendars.

The energy storage 823 of the analog subsystem of the hybrid smart watch provides power to the watch movement 821. The energy storage may be implemented as a battery or a capacitor for a quartz movement, a spring for a mechanical movement, or the like. It may also be augmented by an energy-harvesting mechanism. In some embodiments of the present invention the controller 811 would be able to command the energy transfer unit 840 to transfer some energy from energy storage 813 of the digital subsystem to the energy storage 823 of the analogue subsystem. For example, as the hybrid smart watch is charging from an inductive charger, it may also automatically wind up the spring of the mechanical movement driving the analog subsystem of the hybrid smart watch.

FIG. 1 shows a front view of a hybrid smart watch with a digital display where the hour and minute hands of the analogue watch component overlay the digital display.

Turning to FIG. 1, a hybrid smart watch is shown enclosed in a case 110 with a wrist strap 150. In this particular embodiment, one of many possible embodiments of the current invention, the hybrid smart watch has a rectangular digital display 120. The rectangular display is depicted showing the weather indicators 170 and the Arabic numerals 160 marking the hours. The digital display is driven by the digital subsystem of the hybrid smart watch, while the hour hand 130 and the minute hand 140 are driven by the analog subsystem of the hybrid smart watch. Such an embodiment allows for an easy change of the dial, say from Arabic to Roman numerals, for display of information from various software applications, and for display of the time even when the digital subsystem of the hybrid smart watch has been shut down.

Figure 2:
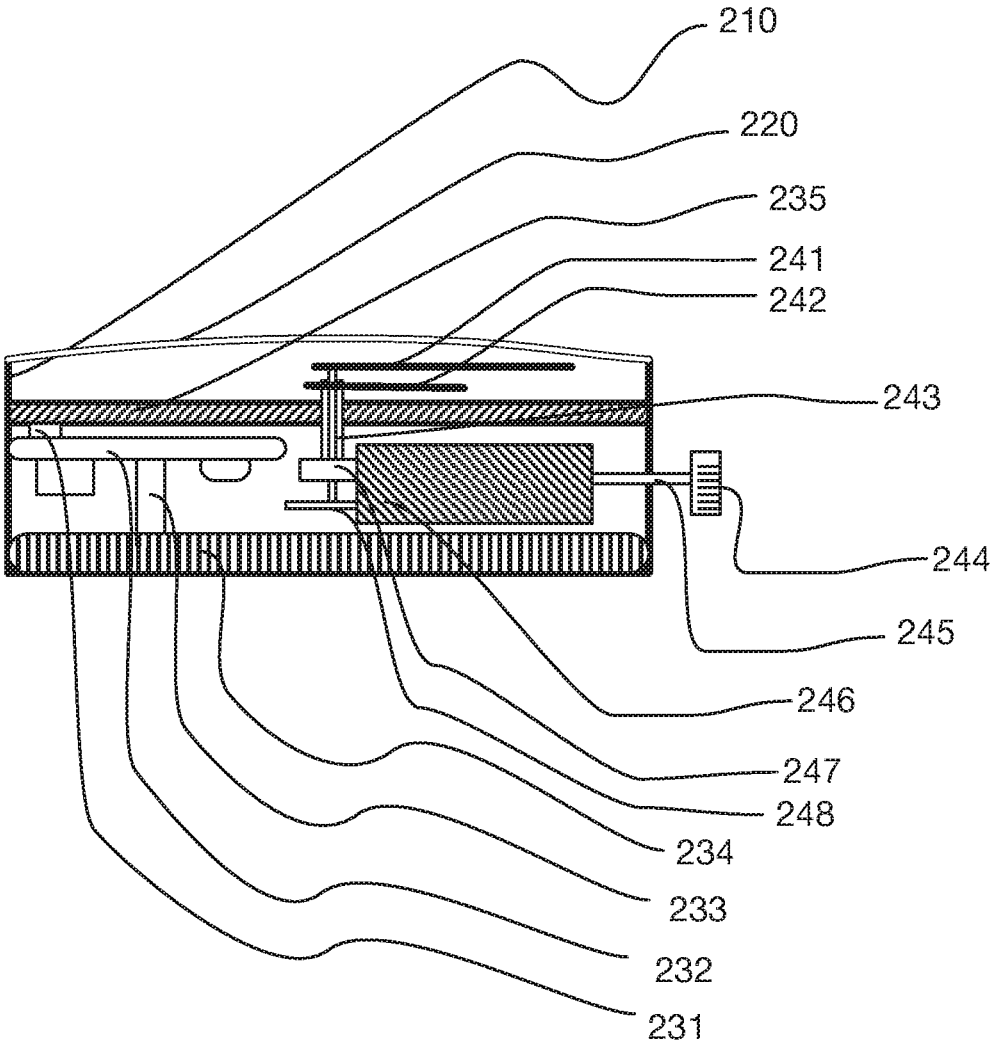
FIG. 2 shows a schematic side view of a hybrid smart watch, where the pinions that drive the hour and minute hands protrude through a hole in the digital display.

FIG. 2 shows a cross-section view of an embodiment of the present invention. The case 210 is covered by a protective lens 220 and contains both the digital and the analog subsystems of the hybrid smart watch.

On FIG. 2 the board 232 with a controller, a communications unit, and other digital components, is connected by leads 233 to the battery 234. The board 232 and the digital components residing on it are also connected by leads 231 to the digital display 235. In some embodiments all or several digital components may be integrated with the digital display and/or the power source.

Further on FIG. 2, the watch movement 246 is shown driving the hour hand 242 and minute hand 241 via the pinions 243 with the hour wheel 247 and the cannon pinion 248. Furthermore, FIG. 2 shows the stem 245 and the crown 244 that can be used to adjust the movement 246.

Thus FIG. 2 provides an illustration of one possible embodiment of the current invention where the pertinent components of the digital and analog subsystems are packaged together to comprise a hybrid smart watch.

Figure 3:
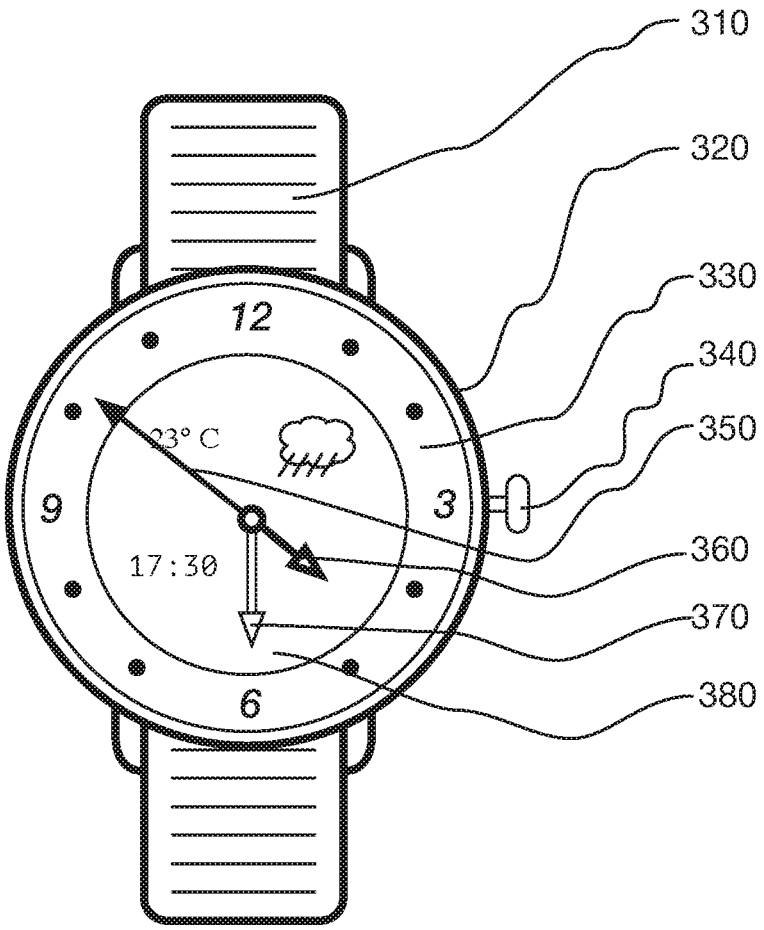
FIG. 3 demonstrates a hybrid smart watch with a round face, a digital display in the center, the permanent hour marks outside the digital display, and the hour and minute hands overlaying the digital display.

FIG. 3 demonstrates another embodiment of the present invention, a hybrid smart watch in a round case 320 with a wrist strap 310, a digital display 380 in the center, an analog dial 330 with permanent hour marks outside of the digital display, and the hour hand 360, minute hand 370 and second hand 350 mounted above the digital display. The crown 340 could be used to adjust the hour and minute hands, or even adjust the time perceived by the digital subsystem of the hybrid smart watch and shown on the digital display 380. Thus in this possible embodiment the analog watch is fully divorced in its representation of time from the digital subsystem, yet the digital subsystem is still intimately integrated within the hybrid smart watch.

Figure 4:
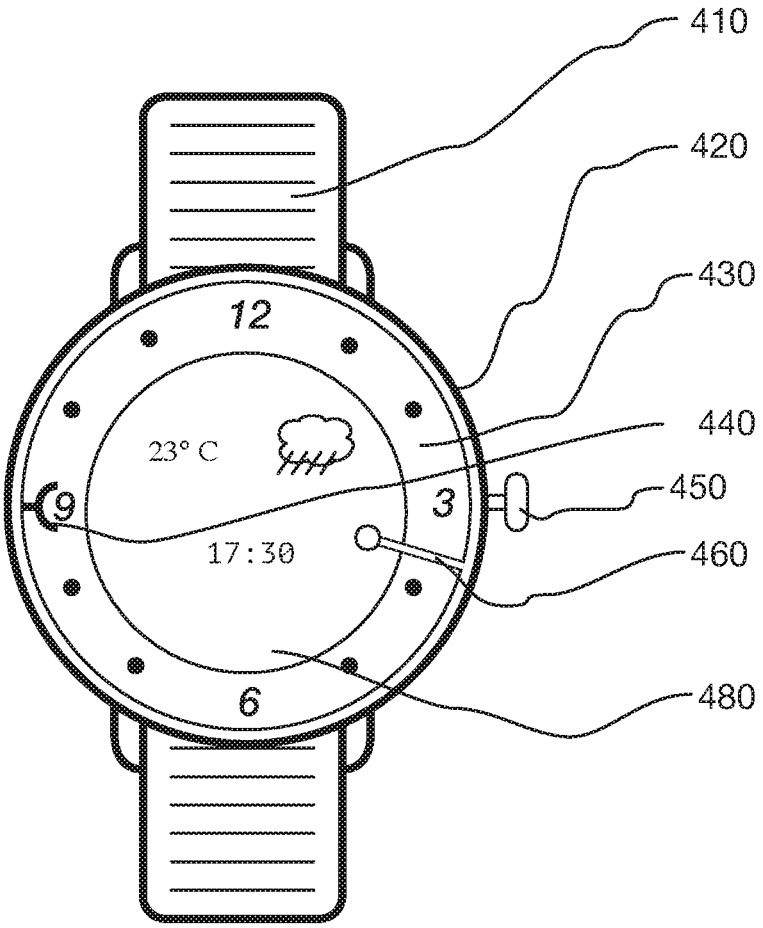
FIG. 4 illustrates a hybrid smart watch with a round face, a digital display in the center, the permanent hour marks outside of the display, and the hour and minute hands driven from the periphery of the watch face.

FIG. 4 illustrates a particular embodiment of the present invention, a hybrid smart watch in a round enclosure 420 with a wrist strap 410, a digital display 480 in the center, and an analog dial 430 with permanent hour marks outside of the digital display. The hour hand 440 and the minute hand 460 are driven from the periphery of the watch face with a mechanism possibly similar (although not limited to) the "Mysterious Wall Clock" from U.S. Pat. No. 2,153,004 issued in 1937. The crown 450 could be used to adjust the hour and minute hands, or even adjust the time perceived by the digital subsystem of the hybrid smart watch and shown on the digital display 480. In this embodiment the analog time indicator does not interfere with the digital display driven by the digital subsystem of the hybrid smart watch, while comprising an integrated device.

Figure 5:
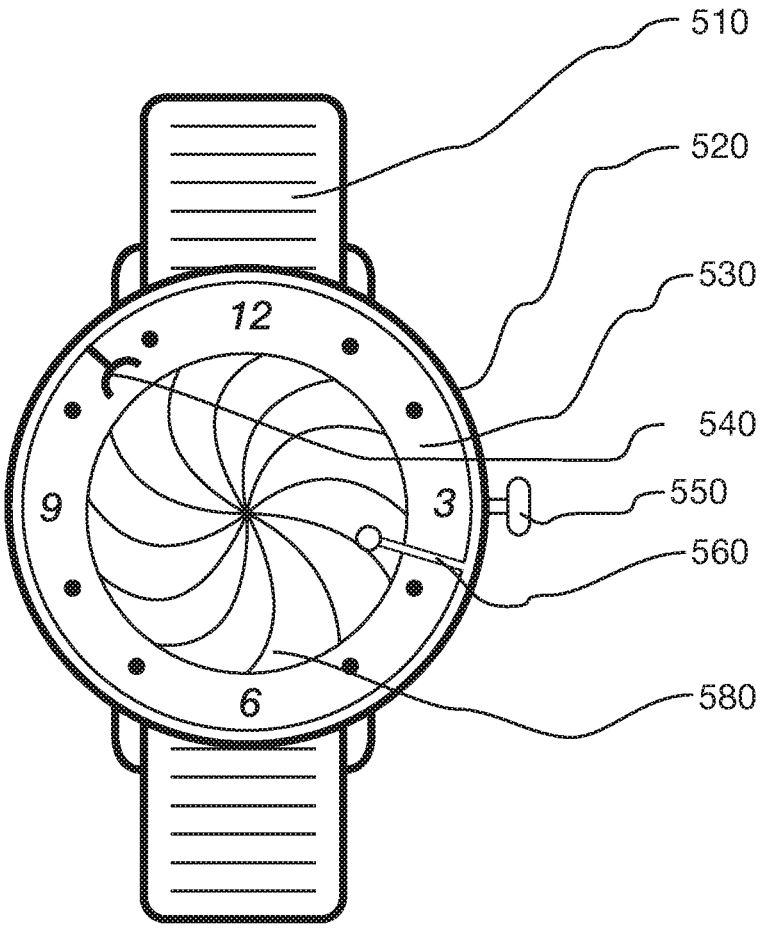
FIG. 5 shows a hybrid smart watch with a round face, a digital display in the center, the permanent hour marks outside of the display, the hour and minute hands driven from the periphery of the watch face, and a closed aperture hiding the digital display.

FIG. 5 shows an advantageous embodiment of the present invention, a hybrid smart watch in a round enclosure 520 with a wrist strap 510, where the digital display is covered with an aperture 580, thus indicating that the display is intentionally switched off. The hour hand 540 and the minute hand 560 are driven from the periphery of the watch face and use the permanent hour marks outside of the display to indicate the time. The crown 550 can be used to control the hybrid smart watch, or can be pushed in to cause the aperture to close and to shut down the digital display, or, subsequently, to open and trigger the switching on of the digital display. When digital display is switched off, the smart watch knows it is not being viewed and thus can go into low power mode. Conversely, when the display is switched on the digital subsystem of the hybrid smart watch can draw more power to achieve higher performance. As such, this overcomes the design problem of poor performance of the smart watch because of power optimizations to improve overall battery life in the prior art.

Figure 9:
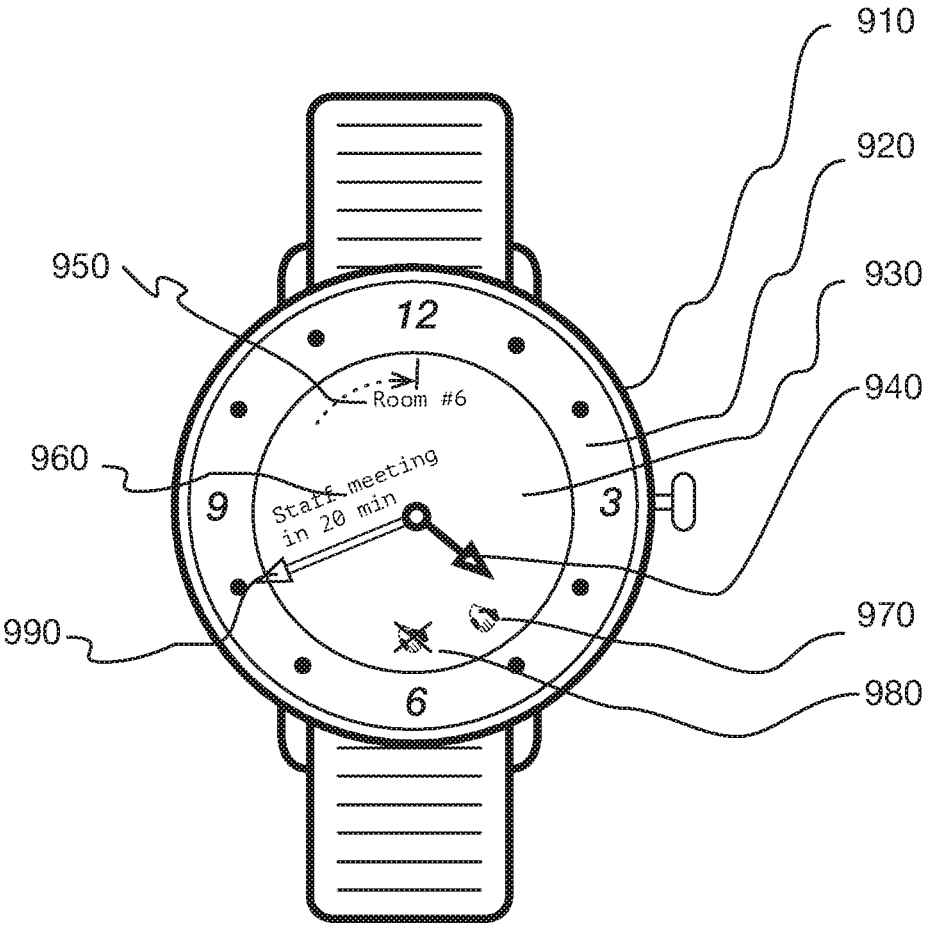
FIG. 9 depicts a hybrid smart watch with a round face, an analog dial and a digital display, and scheduling information text and icons presented on the digital display at the locations next to the current positions of the analog hands and the time markings on the analog dial, so as to be associated with such by the user.

FIG. 9 demonstrates an embodiment of the present invention, a hybrid smart watch in a round case 910 with an analog dial 920, a digital display 930, and analog hands 940 and 990, where time-related information is shown on the digital display at several significant locations. Meeting icons 970 and 980 are shown at five o'clock and six o'clock respectively, indicating scheduled activities. In this example the icon 980 clearly indicates that the six o'clock meeting has been cancelled.

FIG. 9 also demonstrates information 950 regarding the location of the next upcoming activity and the approximate time necessary to get to the location shown on the digital display 930 so that when the minute hand will arrive to the markings, it will be clear to the user that an action is indicated.

FIG. 9 further shows information shown on the digital display 960 next to the current position of the minute hand 990. Thus the time-sensitive data is displayed in its time context for the convenience of the user.

Thus FIG. 9 illustrates various embodiments of the current invention wherein the information on the digital display is shown at significant locations associated with the analog dial and the current position of the analog hands of the hybrid smart watch, thus communicating to the user time-anchored data clearly and succinctly.

Figure 10:
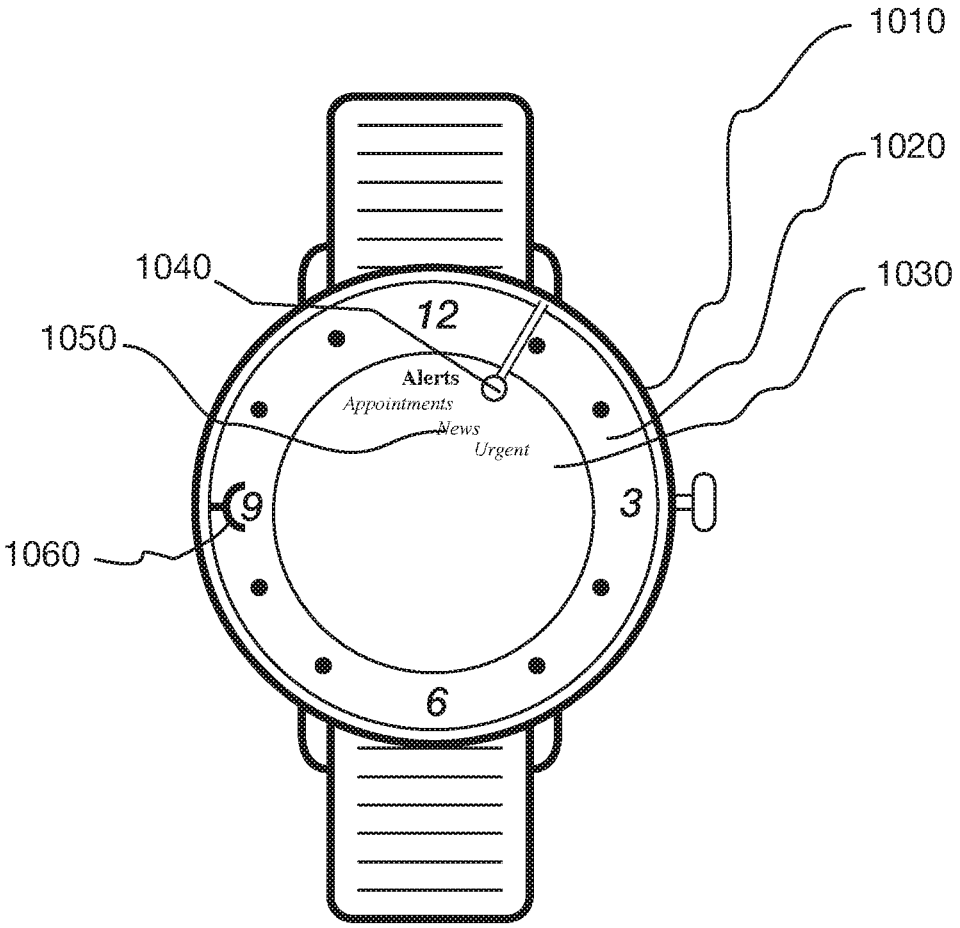
FIG. 10 illustrates a hybrid smart watch with a round face, a digital display in the center, permanent analog time marks on the analog dial outside of the display, and the hour and minute hands driven from the periphery of the watch face; with a menu of selections shown on the digital display and positioned next to the current location of the minute hand.

FIG. 10 illustrates a particular embodiment of the present invention, a hybrid smart watch in an enclosure 1010 with a wrist strap 410, an analog dial 1020, a digital display 1030 and the analog hands: the hour hand 1060 and the minute hand 1040. In this particular embodiment, a menu of easily accessible actions is shown next to the current location of the minute hand, so as to be instantly recognizable by the user reading the time.

Figure 11:
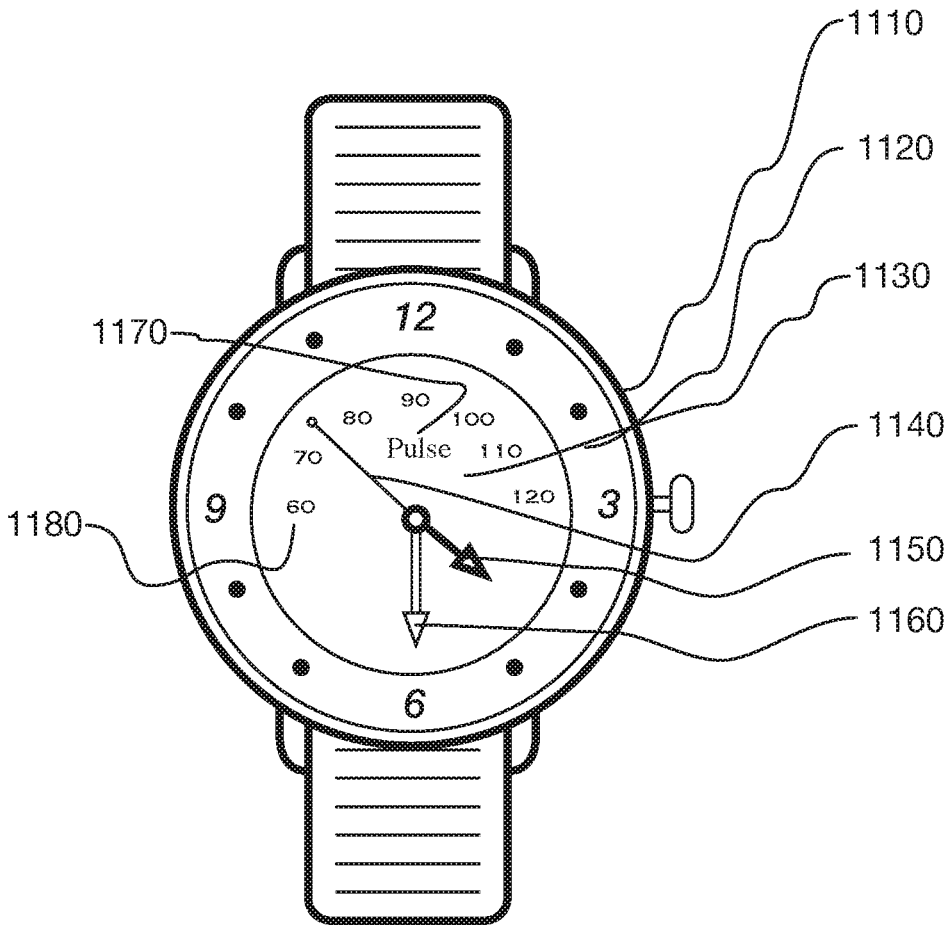
FIG. 11 illustrates a hybrid smart watch with a round face, a digital display in the center, permanent hour marks outside of the digital display, the hour, minute, and second hands overlaying the digital display, with the second hand temporarily detached from the analog watch mechanism and used to indicate pulse relative to the markings shown on the digital display.

Another embodiment taking advantage of the hybrid nature of the smart watch presented in the current invention is depicted in FIG. 11. Here a hybrid smart watch 1110 is shown with an analog dial 1120, a digital display 1130, and the analog hands: the hour hand 1150, the minute hand 1160, and the second hand 1140. The second hand 1140 is shown temporarily detached from the analog subsystem, so that instead of indicating the passage of time, it is controlled by the digital subsystem to indicate pulse, relative to the scale 1180 shown on the digital display, where the function of the scale is further indicated by the label 1170 shown on the digital display. Thus an inherently analog component of a hybrid smart watch can be coupled with the digital subsystem to implement a clearer, less distracting, user interface.

Figure 6:
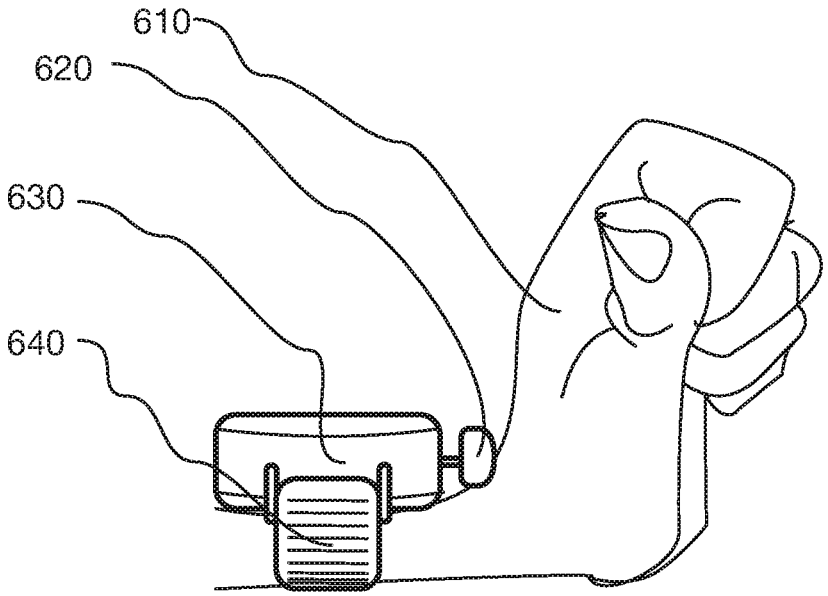
FIG. 6 shows a hybrid smart watch held on a human wrist by a strap, with a crown shaped so that bending the hand towards the watch would push the crown towards the enclosure of the watch, in accordance with an embodiment of the present invention.

FIG. 6 illustrates an embodiment of the current invention where a hybrid smart watch 630 is attached to a wrist 610 by a wrist strap 640. The crown of the watch is given a shape such that when the hand is bent backward, as depicted in FIG. 6, it would push in the crown 620. Such a crown could be used, for example, to trigger the opening/closing of an aperture depicted in FIG. 5 and the switching on and off of the digital display without the need to engage another hand or some other triggering mechanism.

Figure 7:
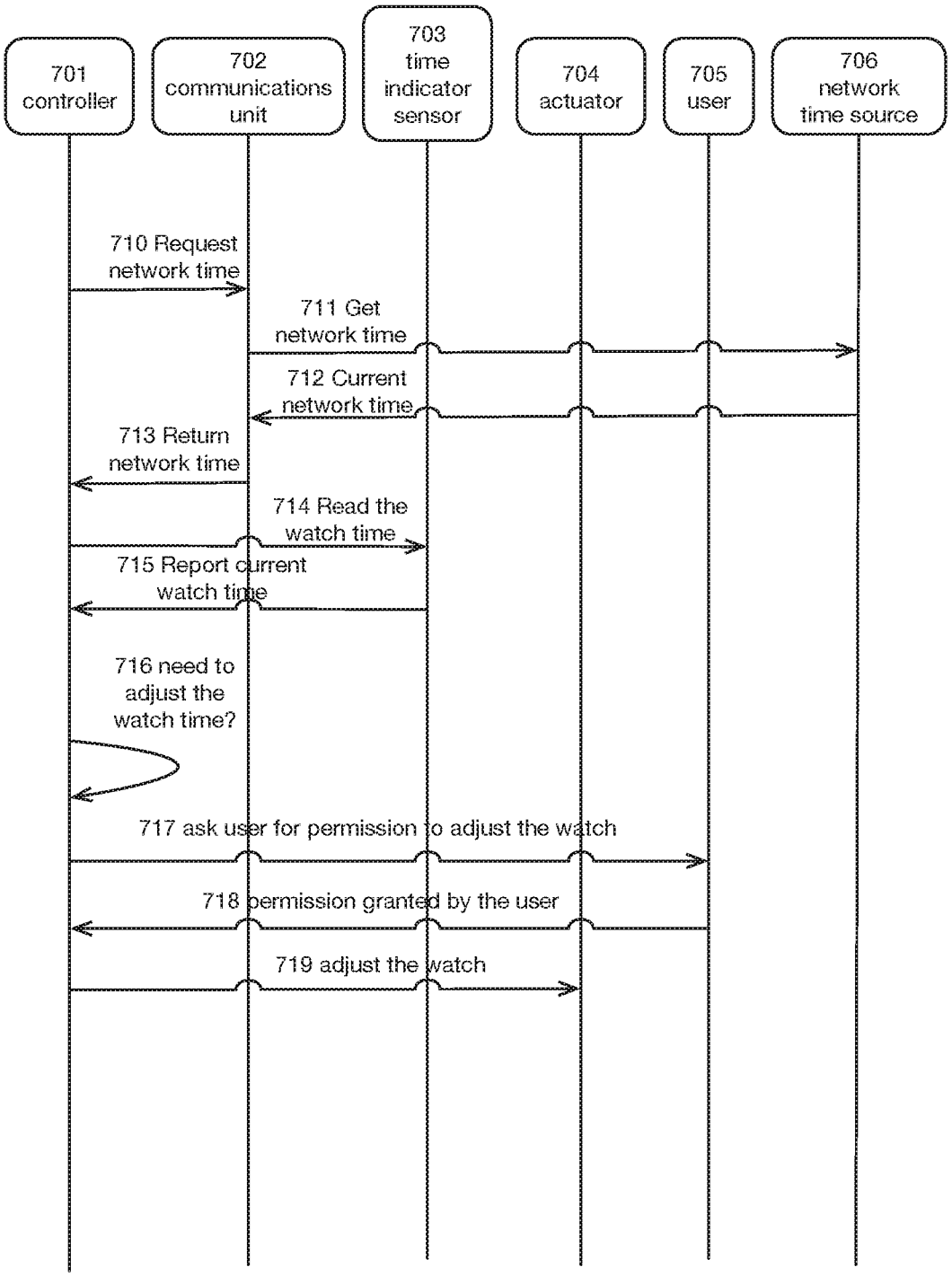
FIG. 7 shows a sequence diagram illustrating the system for adjusting the time shown by the analogue subsystem of a hybrid smart watch.

FIG. 7 is a sequence diagram illustrating a system for adjusting the time shown by the analogue subsystem of a hybrid smart watch.

Turning to FIG. 7, the controller 701 of the digital subsystem of the hybrid smart watch issues the request 710 to the communications unit 702. The communications unit 702 initiates the pertinent network protocol and requests the current network time 711 from the network time source 706. Common examples of a network time source are Network Time Protocol servers like pool.ntp.org, or GPS and cellular networks. In some systems a network time source, like NIST radio station or Global Positioning System satellites, broadcast current time continuously, thus making the step of requesting network time unnecessary. Once the network time source 706 sends the current network time 712 to the communications unit 702, the communications unit 702 returns the network time 713 to the controller 701.

Having received the network time 713, the controller 701 reads the watch time, as displayed by the time indicator, from the time indicator sensor 703. When the indicator sensor 703 reports current watch time 715 to the controller 701, the controller 701 compares it to the network time received earlier and makes a decision 716 whether there is a need to adjust the watch time.

If time adjustment is indicated, the controller 701 raises the request 717 to the user 705 asking for permission to adjust the watch. In various embodiments of the present invention such a request could be issued via a digital display, a dedicated indicator, a sound, a haptic subsystem or by some other means. Once the user 705 issues the permission 718 to adjust the watch, the controller 701 sends the command 719 to adjust the watch to the actuator 704. The actuator 704 would then physically affect the analog time indicator to adjust the time displayed.

CONCLUSION

While this invention has been described in conjunction with the specific embodiments outlined above, it is evident that many alternatives, modifications, and variations will be apparent to those ordinarily skilled in the art. Accordingly, the preferred embodiments of the invention as set forth above are intended to be illustrative, not limiting. Various changes may be made without departing from the spirit and scope of the inventions as defined in the following claims.

What is claimed:

1. A hybrid smart watch, comprising:

a watch casing that physically encloses a digital subsystem and an analog subsystem;

an aperture that is physically coupled to a digital display, the aperture having an open state and a closed state;

the digital subsystem further including at least:

a controller that is configured to perform general calculations and data processing under guidance of an operating system and one or more application software, and a storage unit to store a software component and one or more data sets associated with the controller;

an energy storage unit that is configured to provide the digital subsystem with electric power, the digital display that is configured to present text information and graphical information;

the analog subsystem further including at least:

a mechanical watch movement, a power source for the mechanical watch movement, and a time indicator, and wherein the digital subsystem is communicatively coupled to the analog subsystem; and a sensor communicatively coupled to the digital subsystem that is configured to detect a motion by a wearer of the hybrid smart watch that corresponds to a bending backward of a palm of a hand of the wearer, and wherein, the aperture is configured to toggle between the open state and the closed state in response to a detection of the motion by the wearer.

2. The hybrid smart watch of claim 1, wherein the digital display and the time indicator are combined to form a watch dial, the watch dial presenting one or more visual elements that indicate a time and a date, the one or more visual elements including scale indicators, hands, or numbers.

3. The hybrid smart watch of claim 1, wherein the aperture is further configured to enter the closed state as the digital subsystem enters a low power consumption state or in response to the digital subsystem being switched off.

4. The hybrid smart watch of claim 1, further comprising a physical button, wherein the physical button is physically coupled to the watch casing and communicatively coupled to the digital subsystem, the physical button being configured to receive a user input via a motion by a user wearing the hybrid smart watch that corresponds to bending backward of the palm of the hand wearing the hybrid smart watch.

5. The hybrid smart watch of claim 1, wherein the digital subsystem displays a digital time and a digital date and the analog subsystem displays an analog time, wherein the digital time corresponds to the analog time, and wherein the digital subsystem adjusts at least one of the digital time or the digital date, based at least in part on the analog time.

6. The hybrid smart watch of claim 1, wherein the digital subsystem determines a digital time and a digital date and the analog subsystem displays an analog time, and wherein the digital subsystem adjusts the analog time, based at least in part on the digital time.

7. The hybrid smart watch of claim 6, wherein the analog subsystem further includes a regulator mechanism, and wherein, the digital subsystem adjusts the analog time by adjusting the regulator mechanism, an adjustment by the digital subsystem being based at least in part on the digital time.

8. The hybrid smart watch of claim 1, wherein the power source for the mechanical watch movement that is associated with the analog subsystem is configured to receive an energy charge from an external source of power in response to receipt of a trigger from the digital subsystem, and wherein, the digital subsystem further causes the digital display to present an indication that the energy charge of the analog subsystem is in progress or has been completed.

9. The hybrid smart watch of claim 1, wherein the digital subsystem is further configured to monitor an amount of energy that is stored within the power source for the mechanical watch movement of the analog subsystem, and wherein, the digital subsystem further causes the digital display to present an indication of the amount of energy.

10. The hybrid smart watch of claim 1, wherein the digital subsystem is further configured to provide the power source for the mechanical watch movement of the analog subsystem with an energy charge from the energy storage unit of the digital subsystem.

11. The hybrid smart watch of claim 1, wherein the digital subsystem is further configured to determine a desirability to charge the power source for the mechanical watch movement of the analog subsystem, and wherein the digital subsystem is further configured to provide the power source for the mechanical watch movement of the analog subsystem with an energy charge, based at least in part on receipt of a user input to initiate the energy charge.

12. The hybrid smart watch of claim 1, wherein the time indicator comprises one or more of an hour hand, a minute hand, and a second hand, and wherein the digital subsystem is configured to control one or more movements of the time indicator, the one or more movements of the time indicator being based on a scale of values, other than time values, that are shown on the digital display.

13. The hybrid smart watch of claim 1, wherein the digital subsystem is further configured to receive a user input of a time correction, the time correction corresponding to an amount of time that is to be used to adjust an analog time displayed by the analog subsystem, and wherein, the digital subsystem is further configured to adjust the time indicator of the analog subsystem by the time correction.

14. The hybrid smart watch of claim 1, wherein the watch casing further includes time markings that are positioned radially around the digital display, the time markings to indicate discrete increments of time, and wherein the digital subsystem is further configured to display time-related information on the digital display, the time-related information being displayed in a position that substantially aligns with a time marking that is temporally related to the time-related information.

15. The hybrid smart watch of claim 1, wherein the digital subsystem is configured to control the time indicator of the analog subsystem, the time indicator being temporarily detached from an analog clock mechanism of the analog subsystem, and wherein the digital subsystem is further configured to control a movement of the time indicator to indicate a particular value that is relative to a scale displayed on the digital display.

16. The hybrid smart watch of claim 1, wherein the closed state is configured to obstruct the digital display but not the time indicator.

17. The hybrid smart watch of claim 1, wherein the open state is configured to not obstruct the digital display and the time indicator.

* * * * *